US010381778B2

(12) United States Patent
Ishida et al.

(10) Patent No.: US 10,381,778 B2
(45) Date of Patent: Aug. 13, 2019

(54) CONNECTOR AND WIRE HARNESS

(71) Applicant: Yazaki Corporation, Tokyo (JP)

(72) Inventors: Takuya Ishida, Tochigi (JP); Tomoyuki Miyakawa, Tochigi (JP); Shuhei Nakada, Tochigi (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 15/700,623

(22) Filed: Sep. 11, 2017

(65) Prior Publication Data

US 2018/0076567 A1 Mar. 15, 2018

(30) Foreign Application Priority Data

Sep. 13, 2016 (JP) ..... 2016-178487

(51) Int. Cl.
*H01R 13/631* (2006.01)
*H01R 13/514* (2006.01)
(Continued)

(52) U.S. Cl.
CPC ..... *H01R 13/631* (2013.01); *H01R 13/514* (2013.01); *H01R 13/516* (2013.01);
(Continued)

(58) Field of Classification Search
CPC ..... H01R 13/5202; H01R 13/743; H01R 13/5208; H01R 13/745; H01R 13/6315; H01R 33/00
(Continued)

(56) References Cited

U.S. PATENT DOCUMENTS 5,643,015 A * 7/1997 Wakata ..... H01R 13/4361 439/701
5,913,703 A * 6/1999 Suzuki ..... H01R 13/518 439/489
(Continued)

FOREIGN PATENT DOCUMENTS

CN 104620448 A 5/2015
JP 6374027 U 5/1988
(Continued)

OTHER PUBLICATIONS

Communication dated Jul. 24, 2018, from the Japanese Patent Office in counterpart application No. 2016-178487.
(Continued)

*Primary Examiner* — Hien D Vu
(74) *Attorney, Agent, or Firm* — Sughrue Mion, PLLC

(57) ABSTRACT

A connector applied to a wire harness includes a terminal that can be connected to a counterpart terminal arranged in a counterpart connector and a connector housing that includes the terminal arranged therein along an axial direction and can be engaged with the counterpart connector along the axial direction. The connector housing includes a notched part that enables a counterpart terminal holding part that holds the counterpart terminal and is exposed to the outside in the counterpart connector to move to an axial direction engagement initial position at which the terminal and the counterpart terminal are opposed to each other in the axial direction from the outside of the connector housing along an intersecting direction intersecting with the axial direction.

5 Claims, 11 Drawing Sheets

(51) Int. Cl.

| | |
|---|---|
| ***H01R 13/516*** | (2006.01) |
| ***H01R 13/58*** | (2006.01) |
| ***H01R 24/20*** | (2011.01) |
| *H01R 107/00* | (2006.01) |
| *H01R 13/627* | (2006.01) |
| *H01R 13/74* | (2006.01) |

(52) U.S. Cl.
CPC ..... *H01R 13/582* (2013.01); *H01R 24/20* (2013.01); *H01R 13/6272* (2013.01); *H01R 13/743* (2013.01); *H01R 2107/00* (2013.01)

(58) Field of Classification Search
USPC ..... 439/557, 556, 533
See application file for complete search history.

(56) References Cited

U.S. PATENT DOCUMENTS

| | | | | |
|---|---|---|---|---|
| 6,007,354 | A | 12/1999 | Watanabe et al. | |
| 6,050,859 | A | 4/2000 | Abe et al. | |
| 6,582,256 | B2 * | 6/2003 | Sakurai | H01R 13/518 439/701 |
| 6,666,728 | B2 * | 12/2003 | Tachi | H01R 13/193 439/248 |
| 6,835,094 | B2 * | 12/2004 | Matsushita | H01R 13/5202 439/271 |
| 9,356,391 | B2 * | 5/2016 | Akagi | H01R 13/6395 |
| 2004/0106323 | A1 | 6/2004 | Matsushita | |
| 2015/0222052 | A1 | 8/2015 | Akagi | |

FOREIGN PATENT DOCUMENTS

| | | | |
|---|---|---|---|
| JP | 1154205 | A | 2/1999 |
| JP | 11126644 | A | 5/1999 |
| JP | 2014-53206 | A | 3/2014 |
| JP | 201549964 | A | 3/2015 |
| WO | 2015029703 | A1 | 3/2015 |

OTHER PUBLICATIONS

Communication dated Dec. 17, 2018 from the China National Intellectual Property Administration in counterpart CN application No. 201710816877.1.

* cited by examiner

CONNECTOR AND WIRE HARNESS

CROSS-REFERENCE TO RELATED APPLICATION(S)

The present application claims priority to and incorporates by reference the entire contents of Japanese Patent Application No. 2016-178487 filed in Japan on Sep. 13, 2016.

BACKGROUND OF THE INVENTION

1. Field of the Invention

The present invention relates to a connector and a wire harness.

2. Description of the Related Art

As a conventional connector applied to a wire harness and the like of a vehicle, for example, Japanese Patent Application Laid-open No. 2014-053206 discloses a panel-fixed type connector device including a first connector housing mounted to an attachment hole of a panel from one side of a direction orthogonal to the panel, and a second connector housing engaged with the first connector housing through the attachment hole from the other side of the direction orthogonal to the panel across the panel. In the panel-fixed type connector device, the connector housings house terminals that are electrically connected to each other when the connector housings are engaged with each other. Accordingly, a first connector and a second connector are configured.

There is room for improvement in the panel-fixed type connector device disclosed in Japanese Patent Application Laid-open No. 2014-053206 in view of improvement in workability, for example.

SUMMARY OF THE INVENTION

In view of the aforementioned problems, the present invention is made in view of such a situation, and provides a connector and a wire harness that can improve workability.

In order to solve the above mentioned problem and achieve the object, a connector according to one aspect of the present invention includes a terminal that is able to be connected to a counterpart terminal arranged in a counterpart connector; and a connector housing that includes the terminal arranged therein along an axial direction and is able to be engaged with the counterpart connector along the axial direction, wherein the connector housing includes a notched part that enables a counterpart terminal holding part that holds the counterpart terminal and is exposed to outside in the counterpart connector to move to an axial direction engagement initial position at which the terminal and the counterpart terminal are opposed to each other in the axial direction from outside of the connector housing along an intersecting direction intersecting with the axial direction.

According to another aspect of the present invention, in the connector, it is preferable that the connector housing includes a terminal holding part that holds the terminal along the axial direction, and a hood part that forms an engagement space part to which a distal end of the terminal held by the terminal holding part is exposed and with which the counterpart terminal holding part is able to be engaged, the engagement space part includes a terminal exposing space part at which the terminal exposed to inside of the engagement space part is positioned, and a movable space part adjacent to the terminal exposing space part along the axial direction, and the hood part includes the notched part formed at a position opposed to the movable space part in the intersecting direction.

According to still another aspect of the present invention, in the connector, it is preferable that the hood part includes an inner hood part that configures a sub-connector integrally with the terminal holding part, and an outer hood part that is formed separately from the sub-connector outside the inner hood part in the intersecting direction to be detachable from the sub-connector, and the notched part is formed on the outer hood part and the inner hood part.

According to still another aspect of the present invention, in the connector, it is preferable that the hood part has a tapered part formed to incline toward the notched part with respect to the axial direction and the intersecting direction at an end part opposite to the terminal holding part in the axial direction.

According to still another aspect of the present invention, in the connector, it is preferable that the connector housing has a flange part formed projecting along the intersecting direction from an outer face closer to the movable space part with respect to a boundary position between the terminal exposing space part and the movable space part in the axial direction, and the flange part abuts on the counterpart terminal holding part to be positioned in the axial direction.

According to still another aspect of the present invention, in the connector, it is preferable that the connector housing includes a terminal holding part that holds the terminal along the axial direction, and a hood part that covers the terminal holding part and forms an engagement space part with which the counterpart terminal holding part is able to be engaged, the engagement space part includes a terminal holding part space part at which the terminal holding part is positioned and a movable space part adjacent to the terminal holding part space part along the axial direction, and the hood part includes the notched part formed at a position opposed to the movable space part in the intersecting direction.

In order to achieve the object, a wire harness according to still another aspect of the present invention includes a conductive wiring material; and a connector that is connected to the wiring material, wherein the connector includes: a terminal that is connected to the wiring material and is able to be connected to a counterpart terminal arranged in a counterpart connector; and a connector housing that includes the terminal arranged therein along an axial direction and is able to be engaged with the counterpart connector along the axial direction, and the connector housing including a notched part that enables a counterpart terminal holding part that holds the counterpart terminal and is exposed to outside in the counterpart connector to move to an axial direction engagement initial position at which the terminal and the counterpart terminal are opposed to each other in the axial direction from outside of the connector housing along an intersecting direction intersecting with the axial direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
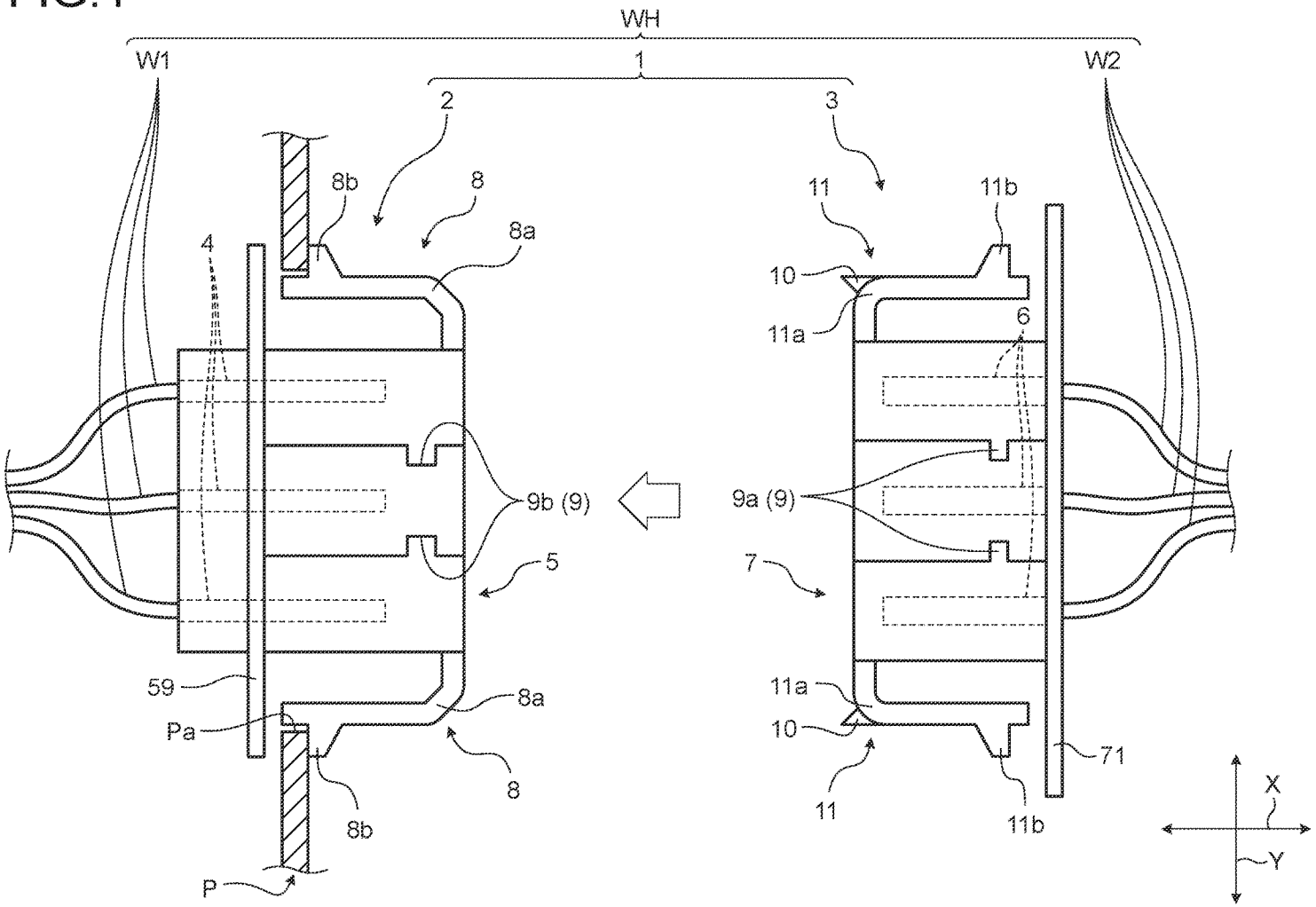
FIG. 1 is a typical configuration diagram representing a schematic configuration of a connector mechanism according to an embodiment.
Figure 2:
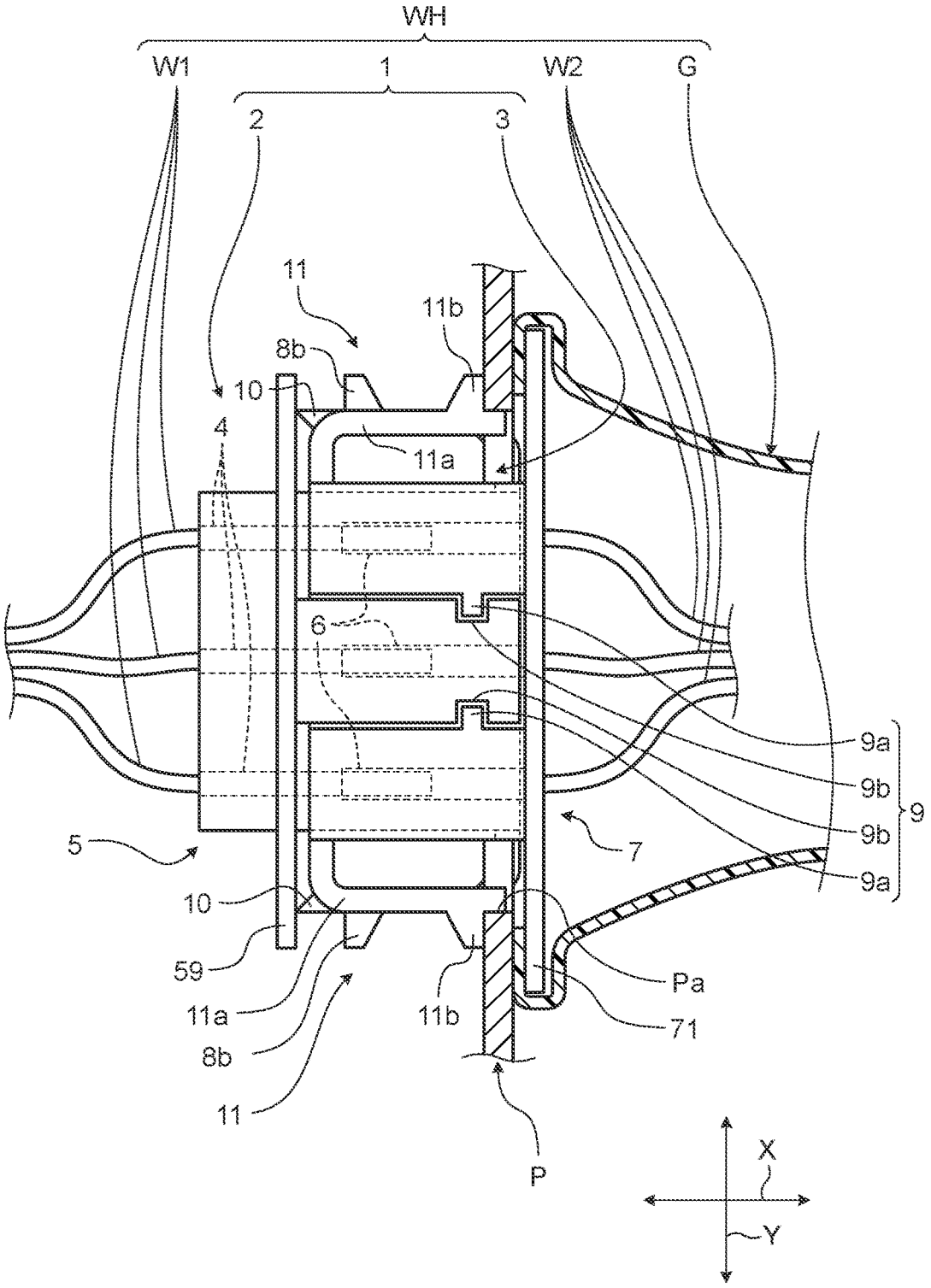
FIG. 2 is a typical configuration diagram representing a schematic configuration of the connector mechanism according to the embodiment.
Figure 6:
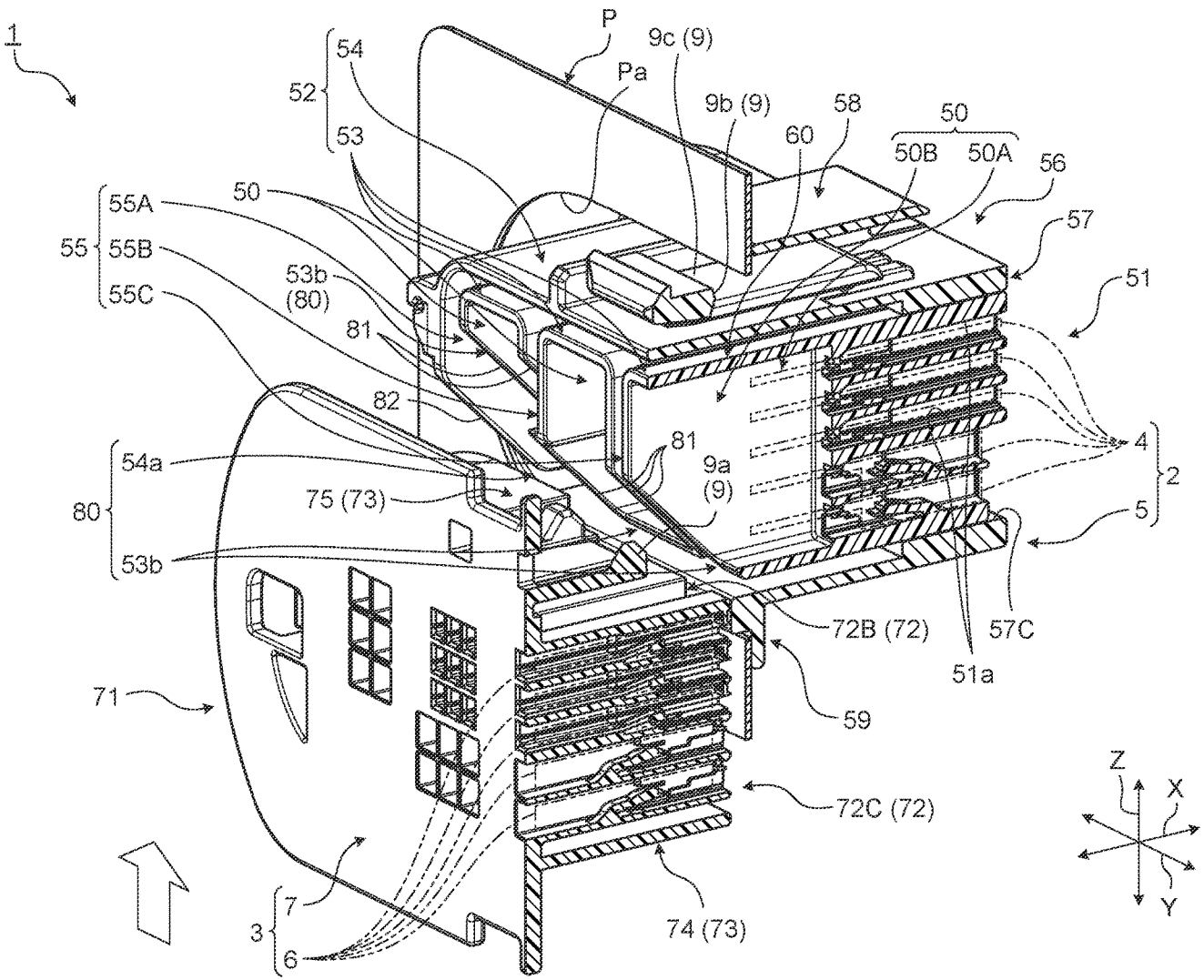
FIG. 6 is a cross-sectional perspective view for explaining an engaging operation of the connector mechanism according to the embodiment.
Figure 7:
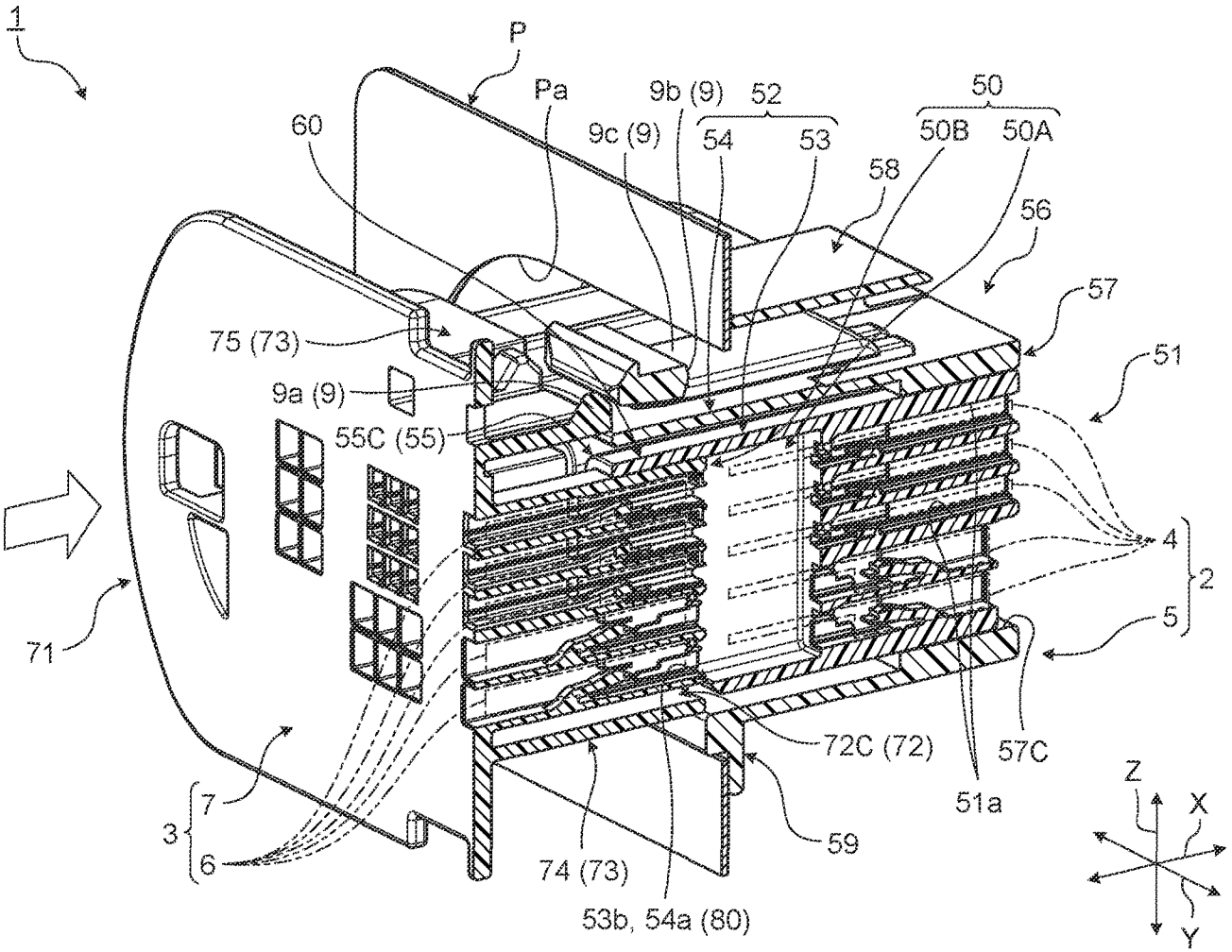
FIG. 7 is a cross-sectional perspective view for explaining an engaging operation of the connector mechanism according to the embodiment.
Figure 8:
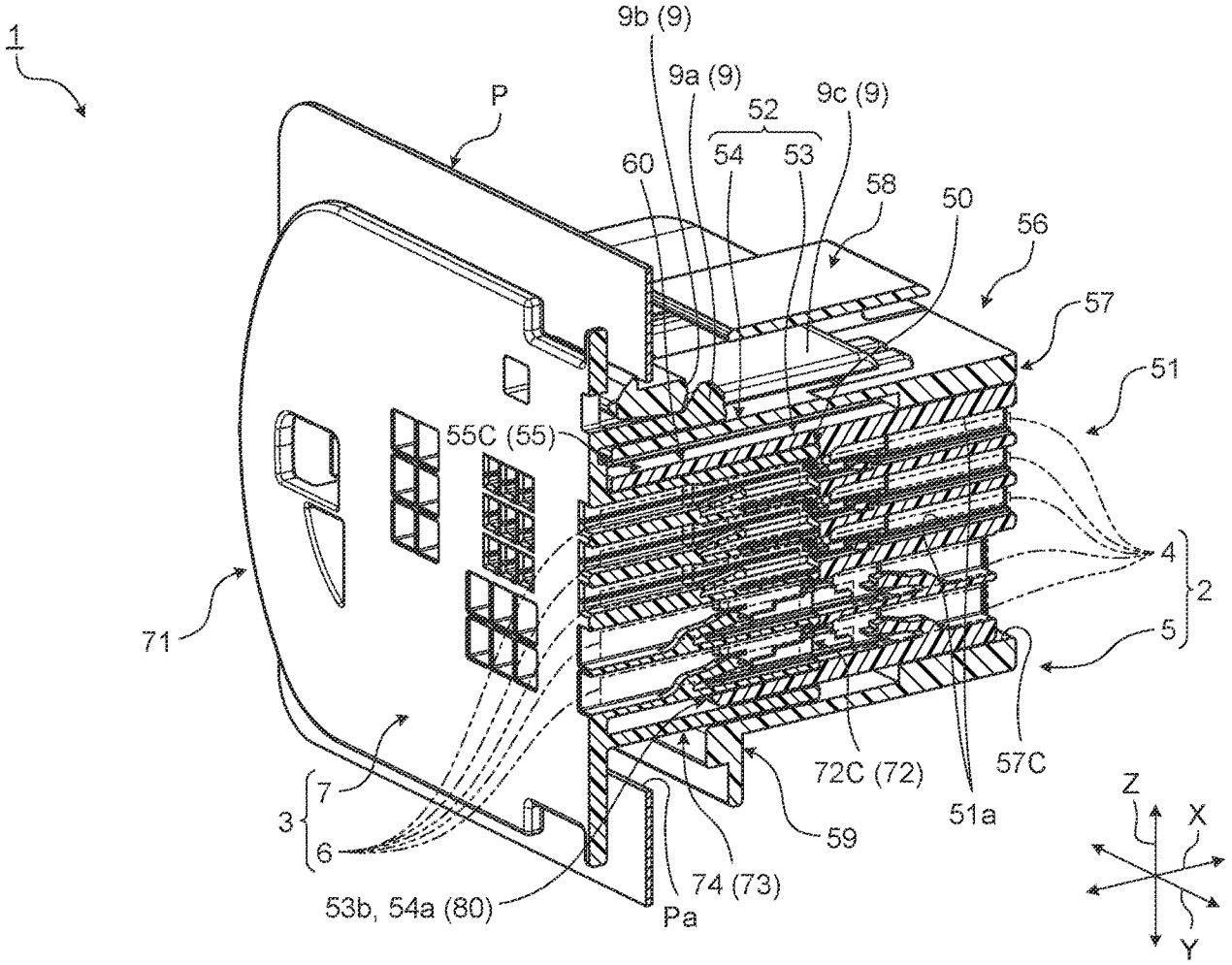
FIG. 8 is a cross-sectional perspective view for explaining an engaging operation of the connector mechanism according to the embodiment.

FIGS. 1 and 2 illustrate terminals with dotted lines, FIGS. 6, 7, and 8 illustrate the terminals with two-dot chain lines, and the terminals are not illustrated in the other drawings. In the drawings, only part of an attachment panel is illustrated. In the following description, among a first direction, a second direction, and a third direction intersecting with each other, the first direction is referred to as an "axial direction X", the second direction is referred to as a "width direction Y", and the third direction is referred to as a "height direction Z". Herein, the axial direction X, the width direction Y, and the height direction Z are orthogonal to each other, and the width direction Y and the height direction Z correspond to an intersecting direction with respect to the axial direction X. Typically, the axial direction X corresponds to an extending direction of terminals held by a connector housing described later, that is, a direction along an extending direction of a terminal insertion chamber for holding the terminals, and is a direction along an inserting direction for inserting the terminals into the terminal insertion chamber. The axial direction X corresponds to a plate thickness direction of the attachment panel described later, and the width direction X and the height direction Z correspond to an extending direction of the attachment panel. Each direction used in the following description represents a direction in a state in which components are assembled to each other unless otherwise specified.

Embodiment

A connector mechanism 1 according to an embodiment illustrated in FIGS. 1 and 2 is applied to a wire harness WH and the like used for a vehicle, for example. For example, the wire harness WH is obtained by bundling a plurality of wiring materials W1 and W2 used for power supply or signal communication to be a collective component for connecting devices mounted on the vehicle, and causing the wiring materials W1 and W2 to be connected to the respective devices at a time with the connector mechanism 1 and the like. The wire harness WH includes the conductive wiring materials W1 and W2 and the connector mechanism 1 connected to the wiring materials W1 and W2. The wire harness WH may further include a fixture, a protector, a grommet G (described later), and the like. For example, the wiring materials W1 and W2 are configured of a metal bar made by covering the outside of a conductive rod-like member with an insulative covering part, an electric wire made by covering the outside of a conductor part (core wire) including a plurality of conductive metal wires with an insulative covering part, an electric wire bundle made by bundling the electric wires, and the like.

The connector mechanism 1 according to the present embodiment is a connection mechanism for connecting a wiring material to a wiring material that connects the wiring material W1 to the wiring material W2 configuring the wire harness WH. The connector mechanism 1 includes a first connector 2 and a second connector 3. The first connector 2 includes a plurality of terminals 4 and a connector housing 5. The second connector 3 includes a plurality of terminals 6 and a connector housing 7. The terminals 4 and 6 are metal fittings configured of a conductive metallic material that are electrically connected to terminals of the wiring materials W1 and W2, respectively. Each of the terminals 4 and 6 can be connected to a counterpart terminal arranged in a counterpart connector. The connector housings 5 and 7 include the terminals 4 and 6 arranged therein along the axial direction X, and house and hold the terminals 4 and 6, respectively. Each of the connector housings 5 and 7 can be engaged with the counterpart connector, and is configured of an insulating resin material. The counterpart connector to be engaged with the connector housing 5 is the second connector 3, and the counterpart terminal to be connected to the terminal 4 is the terminal 6 arranged in the second connector 3. The counterpart connector to be engaged with the connector housing 7 is the first connector 2, and the counterpart terminal to be connected to the terminal 6 is the terminal 4 arranged in the first connector 2. That is, the connector housing 5 configuring the first connector 2 and the connector housing 7 configuring the second connector 3 are engaged with each other. By way of example, the first connector 2 is a male connector in which the connector housing 5 holds the male terminal 4, and the second connector 3 is a female connector in which the connector housing 7 holds the female terminal 6. In the connector mechanism 1, the connector housing 5 of the first connector 2 and the connector housing 7 of the second connector 3 are engaged with each other basically along the axial direction X to make a connector joint, the terminal 4 and the terminal 6 included therein are electrically connected to each other, and an electrically connected part is formed therebetween.

By way of example, the connector mechanism 1 according to the present embodiment configures a connection mechanism that connects the wiring material W1 routed on a body side of the vehicle with the wiring material W2 routed on a door side of the vehicle. The connector mechanism 1 is a panel-fixed type connector fixed to an attachment panel P interposed between a routing space on the body side and a routing space on the door side. In the connector mechanism 1 according to the present embodiment, to secure workability in an engaging operation, one of the first connector 2 and the second connector 3 configures a receiving side connector, and the other one thereof configures an assembling side connector. The first connector 2 configures a receiving side connector that is temporarily locked to an attachment hole Pa formed on the attachment panel P interposed between the body and the door from one side of the attachment panel P (for example, an inner side of the body). On the other hand, the second connector 3 configures an assembling side connector that is connector-engaged with the first connector 2 serving as the receiving side connector temporarily locked to the attachment hole Pa from the other side of the attachment panel P (for example, an outer side of the body), and is finally locked to the attachment hole Pa. The attachment hole Pa passes through the attachment panel P in the axial direction X to cause two spaces partitioned on both sides of the axial direction X across the attachment panel P as a boundary to communicate with each other. For example, in the connector mechanism 1, the first connector 2 is positioned inside the vehicle, and the second connector 3 is positioned outside of the vehicle assuming that the attachment panel P is a boundary.

In the connector mechanism 1, the connector housing 7 of the second connector 3 is engaged with the connector housing 5 of the first connector 2 temporarily locked to the attachment hole Pa to lock the connector housing 5 and the connector housing 7 to each other, the temporarily locked connector housing 5 is released to be free, and the connector housing 7 is finally locked to the attachment hole Pa from the other side. To implement these functions, the connector mechanism 1 according to the present embodiment includes locking mechanisms 8 for a temporal lock, locking mechanisms 9 for locking a connector, releasing projection parts 10 for releasing a temporal lock, and locking mechanisms 11 for a final lock. The locking mechanisms 8 and 11 can lock the connector housings 5 and 7 to the attachment panel P, respectively. The locking mechanisms 9 can lock the connector housing 5 and the connector housing 7 to each other. Each of the releasing projection parts 10 releases a lock by the corresponding locking mechanism 8 in accordance with the engaging operation of the connector housing 5 and the connector housing 7.

Specifically, each of the locking mechanisms 8 for a temporal lock is arranged in the first connector 2, and can temporarily lock the connector housing 5 to the attachment panel P. The locking mechanism 8 temporarily locks the first connector 2 to an attachment edge of the attachment panel P when a lock beak part 8*b* arranged on an arm part 8*a* is locked to the attachment edge forming the attachment hole Pa of the attachment panel P. Herein, the locking mechanisms 8 are arranged, as a pair, at positions opposed to each other along the width direction Y. Each of the locking mechanisms 9 for locking a connector locks the first connector 2 to the second connector 3 when a locking claw part 9*a* is locked to a part 9*b* to be locked in a state in which the first connector 2 is completely engaged with the second connector 3 (state in which the terminal 4 is properly electrically connected to the terminal 6). The locking claw part 9*a* is arranged in one of the first connector 2 and the second connector 3 (in this case, the second connector 3), and the part 9*b* to be locked is arranged in the other one of the first connector 2 and the second connector 3 (in this case, the first connector 2). The locking mechanism 9 is arranged at a substantially center part in the width direction Y of the connector mechanism 1. The releasing projection part 10 for releasing a temporal lock is arranged in the second connector 3, and releases a temporal lock between the connector housing 5 and the attachment panel P by the locking mechanism 8 in accordance with an operation of engaging the second connector 3 with the first connector 2. The releasing projection part 10 abuts on the lock beak part 8*b* in a temporarily locked state and causes the arm part 8*a* to be bent inward (toward a main body side) in accordance with the operation of engaging the second connector 3 with the first connector 2, and releases a lock between the lock beak part 8*b* and the attachment edge of the attachment panel P to release a temporal lock between the first connector 2 and the attachment edge of the attachment panel P. Herein, releasing projection parts 10 are arranged, as a pair, at positions opposed to each other along the width direction Y. Each of the locking mechanisms 11 for a final lock is arranged in the second connector 3, and can finally lock the connector housing 7 to the attachment panel P. The locking mechanism 11 finally locks the second connector 3 to the attachment edge of the attachment panel P when a lock beak part 11*b* arranged on an arm part 11*a* is locked to the attachment edge forming the attachment hole Pa of the attachment panel P. Herein, the locking mechanisms 11 are arranged, as a pair, at positions opposed to each other along the width direction Y. In this case, the arm part 8*a* and the arm part 11*a* are arranged in a positional relation of not interfering with each other in the engaging operation of the first connector 2 and the second connector 3.

The connector mechanism 1 according to the present embodiment has a configuration in which, when the connector housing 5 of the first connector 2 and the connector housing 7 of the second connector 3 are engaged with each other along the axial direction X, the first connector 2 and the second connector 3 can be relatively moved to be assembled along the intersecting direction intersecting with the axial direction X, herein, the height direction Z, and can be engaged with each other along the axial direction X, which improves workability. The following describes configurations of the first connector 2 and the second connector 3 with reference to the drawings.

As described above, the first connector 2 includes a plurality of terminals 4 and the connector housing 5, and the terminals 4 are arranged along the axial direction X in the connector housing 5. In the following description, a side in the axial direction X of the first connector 2 with which the second connector 3 is engaged may be referred to as a front side, and the opposite side thereof may be referred to as a rear side.

Figure 3:
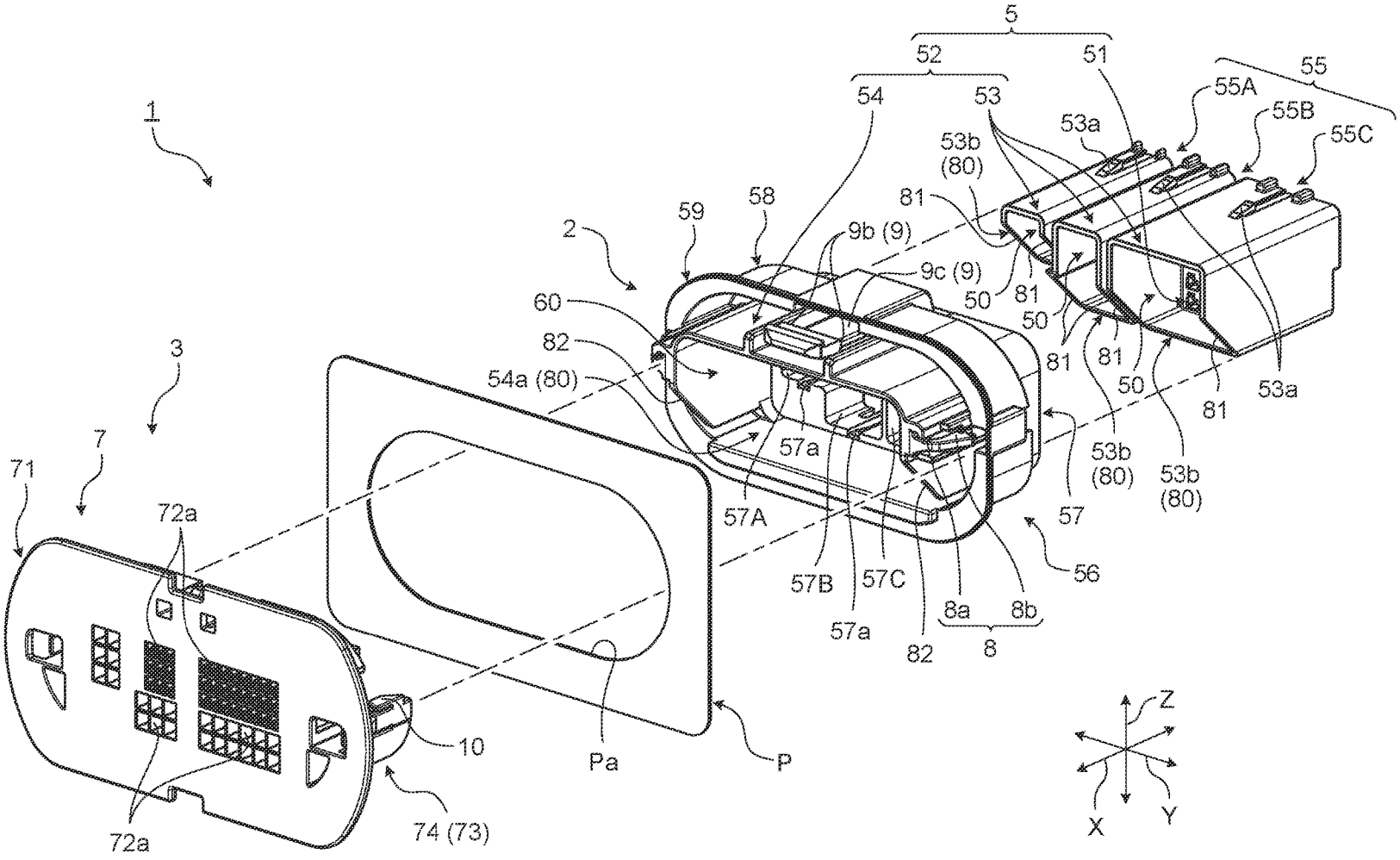
FIG. 3 is an exploded perspective view representing a schematic configuration of the connector mechanism according to the embodiment.
Figure 4:
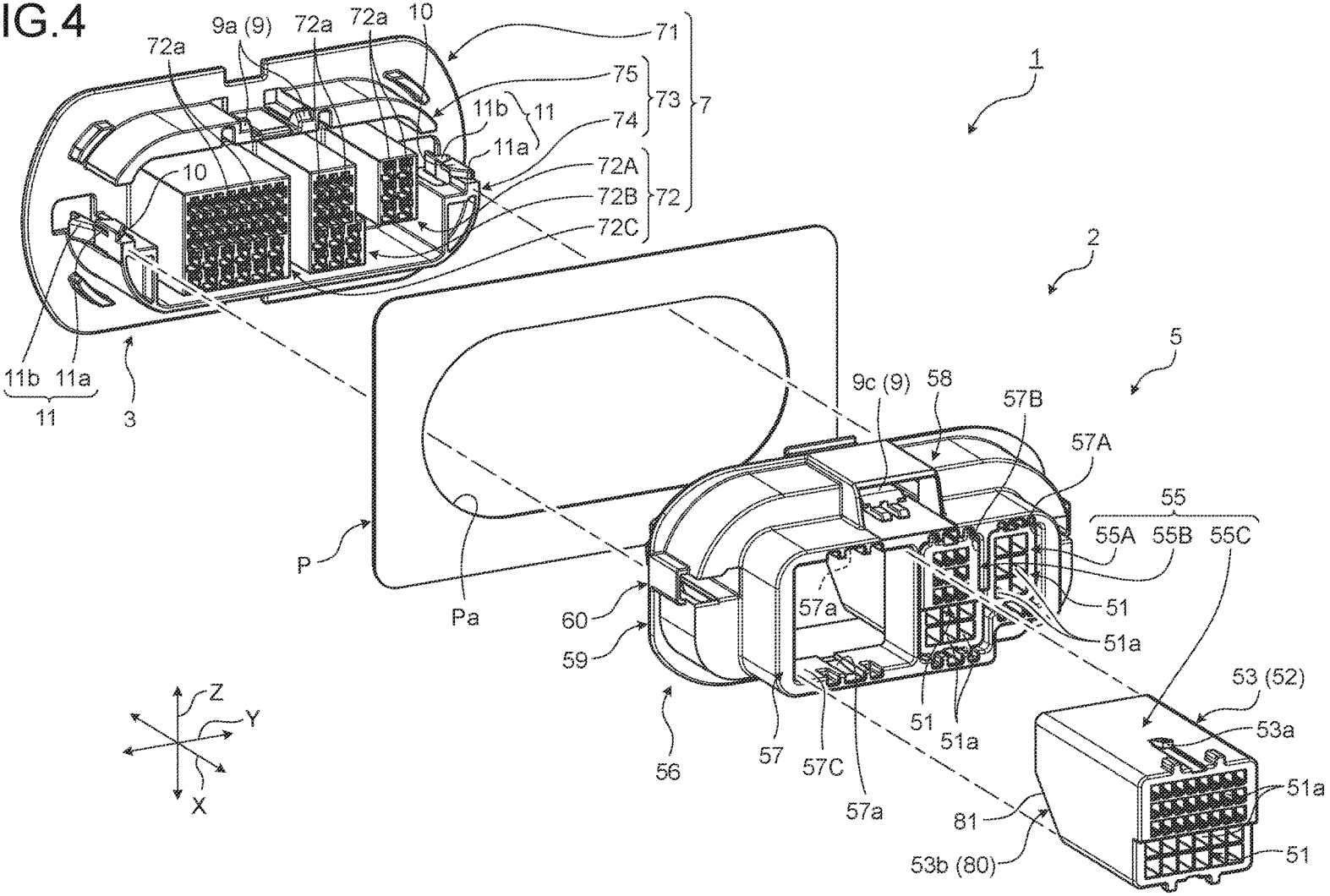
FIG. 4 is an exploded perspective view representing a schematic configuration of the connector mechanism according to the embodiment.
Figure 5:
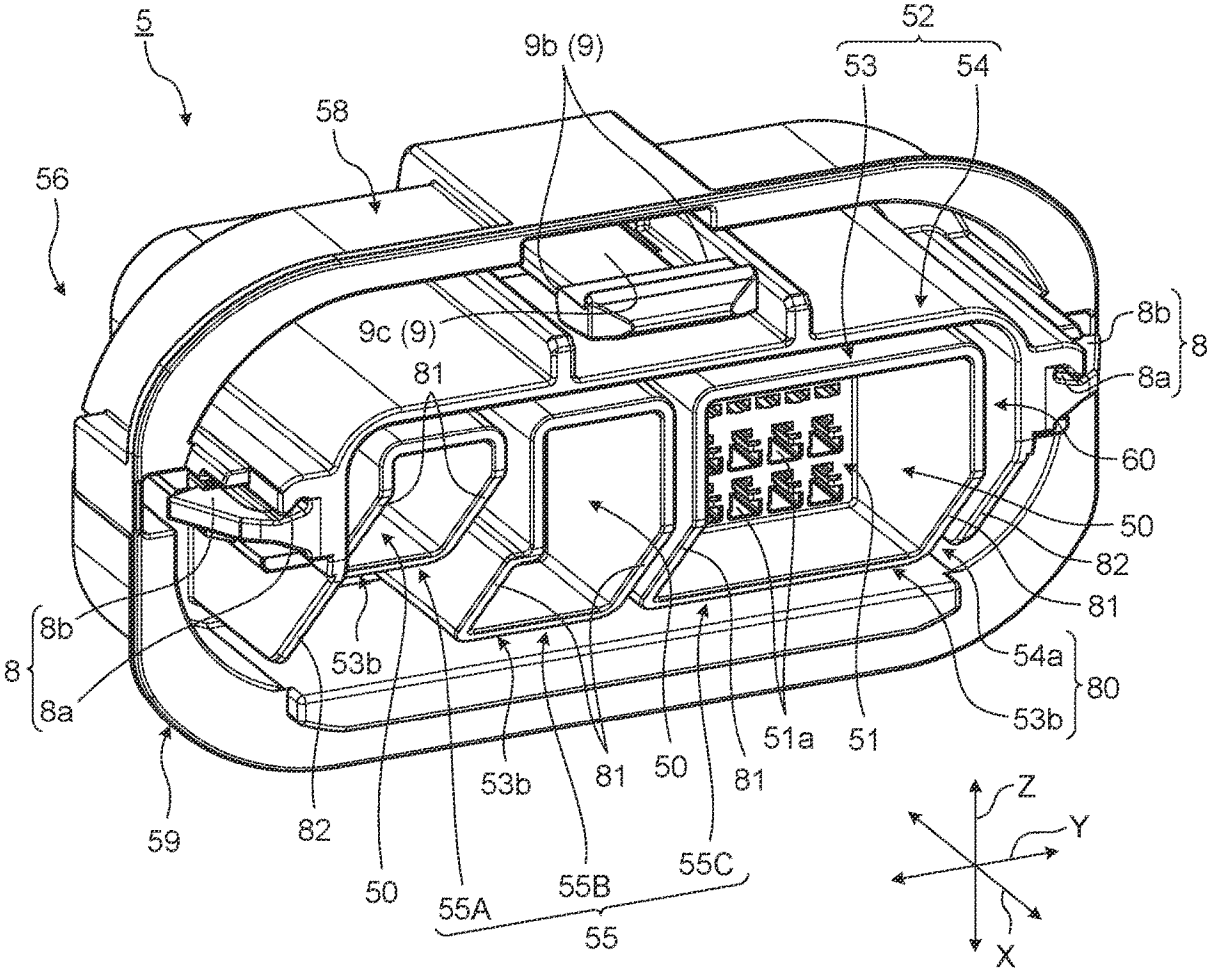
FIG. 5 is a perspective view representing a schematic configuration of a connector housing of a first connector of the connector mechanism according to the embodiment.

Specifically, as illustrated in FIGS. 3, 4, and 5, the connector housing 5 includes a terminal holding part 51 and a hood part 52. The connector housing 5 according to the present embodiment is configured such that the hood part 52 includes an inner hood part 53 and an outer hood part 54. Herein, the inner hood part 53 configures a sub-connector 55 integrally with the terminal holding part 51, and the outer hood part 54 configures a main body part 56. That is, the connector housing 5 includes the sub-connector 55 including the terminal holding part 51 and the inner hood part 53, and the main body part 56 including the outer hood part 54. The connector housing 5 is configured such that the sub-connector 55 and the main body part 56 are separately formed to be detachable from each other. That is, the outer hood part 54 included in the main body part 56 is formed separately from the sub-connector 55, and is configured to be detachable from the sub-connector 55.

The sub-connector 55 includes the terminal holding part 51 and the inner hood part 53 to be integrally formed. A plurality of sub-connectors 55 are arranged. Herein, arranged are three connectors in total, that is, a first sub-connector 55A, a second sub-connector 55B, and a third sub-connector 55C. The first sub-connector 55A, the second sub-connector 55B, and the third sub-connector 55C have a substantially similar basic configuration although a shape, a size, and the like thereof are slightly different from one another. Thus, in the following description, when the first sub-connector 55A, the second sub-connector 55B, and the third sub-connector 55C are not required to be particularly distinguished from one another, they are simply referred to as the sub-connector 55.

The terminal holding part 51 is a portion that holds the terminal 4 along the axial direction X (refer to FIG. 6, for example). The terminal holding part 51 is formed in a substantially rectangular parallelepiped shape, and includes a terminal insertion chamber 51*a* formed therein along the axial direction X. The terminal insertion chamber 51*a* passes through the terminal holding part 51 along the axial direction X. The terminal insertion chamber 51*a* is a space part for holding the terminal 4 into which the terminal 4 can be inserted along the axial direction X. The terminal insertion chamber 51*a* may also be referred to as a cavity. The terminal insertion chamber 51*a* extends inside the terminal holding part 51 to be formed in a hollow shape, and houses the terminal 4. The terminal insertion chamber 51*a* extends along the axial direction X. The terminal insertion chamber 51*a* is formed as a space part having a size and a shape into which the terminal 4 can be inserted in accordance with the external shape of the terminal 4. An insertion opening for inserting the terminal 4 is formed on the rear side in the axial direction X of the terminal insertion chamber 51*a*, and an exposure opening for exposing, to the outside, a distal end part of the terminal 4 held by the terminal holding part 51 is formed on the front side thereof. A plurality of terminal insertion chambers 51*a* are arranged side by side along the width direction Y and the height direction Z in accordance with the number of the terminals 4 arranged in each sub-connector 55. The terminal holding part 51 includes a lance and the like arranged therein for locking and holding the terminal 4 inside. The terminal 4 extends along the axial direction X while being held within the terminal insertion chamber 51*a* of the terminal holding part 51 via the lance and the like. A base end part of the terminal 4 held by the terminal holding part 51 as one end part in the axial direction X (an end on the rear side in the axial direction X connected to the wiring material W1) is held by the terminal holding part 51, and a distal end part as the other end part thereof is exposed to an engagement space part 50 described later (refer to FIG. 6, for example).

As described above, the inner hood part 53 configures the hood part 52 together with the outer hood part 54. The hood part 52 forms the engagement space part 50 (refer to FIG. 6, for example). The engagement space part 50 is a space part to which the distal end of the terminal 4 held by the terminal holding part 51 is exposed, and with which a counterpart terminal holding part, herein, a terminal holding part 72 of the second connector 3 (described later) can be engaged. The engagement space part 50 is formed by the inner hood part 53 in each sub-connector 55. The inner hood part 53 is formed in a substantially rectangular cylindrical shape having an axis along the axial direction X in each sub-connector 55. The inner hood part 53 is formed to project toward the front side in the axial direction X (a side on which the exposure opening of the terminal insertion chamber 51*a* is positioned) from the terminal holding part 51. In the inner hood part 53, the end part thereof on the front side in the axial direction X is opened, the end part on the rear side thereof other than the terminal insertion chamber 51*a* is blocked by the terminal holding part 51, and the engagement space part 50 is formed inside (a side on which the exposure opening of the terminal insertion chamber 51*a* is positioned). In other words, the engagement space part 50 is formed inside the inner hood part 53 that configures part of the hood part 52 in each sub-connector 55. A locking part 53*a* is formed on an outer face (a face opposite to the side on which the engagement space part 50 is formed) of the inner hood part 53. The locking part 53*a* is a locking projection part for locking the sub-connector 55 to the main body part 56, and is formed to project from the outer face of the inner hood part 53. The locking part 53*a* is, for example, arranged on both faces in the height direction Z of each sub-connector 55. The inner hood part 53 according to the present embodiment includes a notched part 53*b* formed therein as a configuration for enabling the first connector 2 and the second connector 3 to be relatively moved along the height direction Z to be assembled with each other. The configuration of the notched part 53*b* will be described later in detail.

The main body part 56 includes the outer hood part 54, a sub-connector holding part 57, a cover part 58, and a flange part 59 to be integrally formed. As described above, the main body part 56 is formed separately from the sub-connector 55, and configured to be detachable from the sub-connector 55. The following describes the sub-connector holding part 57 first, and thereafter, describes the outer hood part 54.

The sub-connector holding part 57 is a portion that holds the sub-connector 55 along the axial direction X. The sub-connector holding part 57 is formed in a substantially rectangular parallelepiped shape, and includes engagement holes 57A, 57B, and 57C formed therein along the axial direction X. Each of the engagement holes 57A, 57B, and 57C passes through the sub-connector holding part 57 along the axial direction X. The engagement holes 57A, 57B, and 57C are space parts into which the first sub-connector 55A, the second sub-connector 55B, and the third sub-connector 55C can be inserted along the axial direction X, respectively, the space parts holding the first sub-connector 55A, the second sub-connector 55B, and the third sub-connector 55C. The engagement holes 57A, 57B, and 57C extend inside the sub-connector holding part 57 to be formed in a hollow shape, and house the first sub-connector 55A, the second sub-connector 55B, and the third sub-connector 55C, respectively. The engagement holes 57A, 57B, and 57C extend along the axial direction X. The engagement holes 57A, 57B, and 57C are formed as space parts each having a size and a shape into which the first sub-connector 55A, the second sub-connector 55B, and the third sub-connector 55C can be inserted in accordance with the external shape of the first sub-connector 55A, the second sub-connector 55B, and the third sub-connector 55C. Insertion openings for inserting the first sub-connector 55A, the second sub-connector 55B, and the third sub-connector 55C are formed on the rear side in the axial direction X of the engagement holes 57A, 57B, and 57C, respectively, and an exposure opening is formed on the front side thereof for exposing, to the outside, the distal end part of the terminal 4 held by the terminal holding part 51 of each sub-connector 55. The engagement holes 57A, 57B, and 57C correspond to the first sub-connector 55A, the second sub-connector 55B, and the third sub-connector 55C, respectively, and are arranged side by side along the width direction Y. In the sub-connector holding part 57, a locking part 57*a* is formed on an inner face of each of the engagement holes 57A, 57B, and 57C (a face on a side on which the first sub-connector 55A, the second sub-connector 55B, and the third sub-connector 55C are inserted). The locking part 57*a* is a locking stepped part to which the locking part

53*a* is locked for locking the sub-connector 55 to the main body part 56, and is formed on the inner face of each of the engagement holes 57A, 57B, and 57C. The locking part 57*a* is, for example, arranged on both faces in the height direction Z in each of the engagement holes 57A, 57B, and 57C. The respective sub-connectors 55 are inserted into the engagement holes 57A, 57B, and 57C to be engaged therewith from the inner hood part 53 side, and held within the engagement holes 57A, 57B, and 57C when the locking part 53*a* and the locking part 57*a* are locked to each other. In a state in which the first sub-connector 55A, the second sub-connector 55B, and the third sub-connector 55C are engaged with the engagement holes 57A, 57B, and 57C to be held, the distal end part of the terminal 4 held by the terminal holding part 51 and the inner hood part 53 are positioned within a housing space part 60 described later (refer to FIG. 6, for example).

As described above, the outer hood part 54 configures the hood part 52 together with the inner hood part 53. The outer hood part 54 forms the housing space part 60. The housing space part 60 is a space part for housing the inner hood part 53 of the sub-connector 55 and the distal end part of the terminal 4 held by the terminal holding part 51. Additionally, the engagement space part 50 described above is formed within the housing space part 60, the engagement space part 50 to which the distal end of the terminal 4 is exposed and with which the terminal holding part 72 can be engaged. Herein, the outer hood part 54 is formed in a substantially C-shape when viewed along the axial direction X (viewed in the axial direction) to collectively surround inner hood parts 53 of the sub-connectors 55 from three sides, and forms the housing space part 60 inside. In other words, the outer hood part 54 is formed outside each inner hood part 53 with respect to the intersecting direction, herein, the width direction Y and the height direction Z. The outer hood part 54 is formed to project toward the front side in the axial direction X (a side on which exposure openings of the engagement holes 57A, 57B, and 57C are positioned) from the sub-connector holding part 57. In the outer hood part 54, the end part thereof on the front side in the axial direction X is opened, the end part on the rear side other than the engagement holes 57A, 57B, and 57C is blocked by the sub-connector holding part 57, and the housing space part 60 is formed inside (a side on which the exposure openings of the engagement holes 57A, 57B, and 57C are positioned). In other words, the housing space part 60 is formed inside the outer hood part 54 that configures part of the hood part 52. The outer hood part 54 may also be a portion in which each engagement space part 50 is formed via each inner hood part 53 within the housing space part 60 that is formed inside the outer hood part 54. One side of the outer hood part 54 according to the present embodiment is opened also in the height direction Z, and the opening configures a notched part 54*a* as a configuration for enabling the first connector 2 and the second connector 3 to be relatively moved along the height direction Z to be assembled with each other. The configuration of the notched part 54*a* will be described later in detail. Distal end parts of the outer hood part 54 and the inner hood parts 53 on the front side in the axial direction X are substantially aligned in a state in which the sub-connectors 55 are engaged with the engagement holes 57A, 57B, and 57C to be held.

On the outer hood part 54, arranged are the arm part 8*a* and the lock beak part 8*b* of the locking mechanism 8 for a temporal lock described above, and the part 9*b* to be locked of the locking mechanism 9 for locking a connector. The arm part 8*a* and the lock beak part 8*b* of the locking mechanism 8 are arranged, as a pair, on outer faces (faces opposite to the side on which the housing space part 60 is formed) on both sides in the width direction Y of the outer hood part 54. A base end part of each arm part 8*a* is cantilevered by an outer face of the outer hood part 54, the arm part 8*a* extends in a stick shape along the axial direction X, and a distal end part thereof forms a free end. The base end part of each arm part 8*a* projects along the width direction Y from an end part on the front side in the axial direction X of the outer hood part 54, is bent along the axial direction X, and extends toward the rear side in the axial direction X. The lock beak part 8*b* is arranged on the distal end part side of the arm part 8*a*. Each arm part 8*a* may also be referred to as a lance part that can be elastically deformed along the width direction Y. Two parts 9*b* to be locked of the locking mechanism 9 are formed at a distal end part of an arm part 9*c*. One arm part 9*c* is arranged on an outer face on one side (a side opposite to a side on which the notched part 54*a* described later is arranged) in the height direction Z of the outer hood part 54. A base end part of the arm part 9*c* is cantilevered by the outer face of the outer hood part 54, the arm part 9*c* extends in a stick shape along the axial direction X, and a distal end part thereof forms a free end. The base end part of the arm part 9*c* projects along the height direction Z from an end part on the rear side in the axial direction X of the outer hood part 54, is bent along the axial direction X, and extends toward the front side in the axial direction X. The part 9*b* to be locked is arranged at the distal end part of the arm part 9*c*.

The cover part 58 is a portion that covers part of the outside of the outer hood part 54. The cover part 58 is formed in a substantially long cylindrical shape having an axis along the axial direction X. An end part of the cover part 58 on the front side in the axial direction X is opened, an end part thereof on the rear side is blocked, and the cover part 58 is integrally connected to the outer face of the outer hood part 54. The cover part 58 covers the center portion in the axial direction X of the outer hood part 54 with a space in a radial direction. In other words, the end part on the rear side in the axial direction X of the outer hood part 54 and the end part on the front side in the axial direction X thereof are exposed from the cover part 58. The arm part 8*a* and the lock beak part 8*b* of the locking mechanism 8 and the part 9*b* to be locked and the arm part 9*c* of the locking mechanism 9 described above are positioned between the cover part 58 and the outer face of the outer hood part 54.

A flange part 59 is formed, at a distal end part on the front side in the axial direction X of the cover part 58, to project toward the intersecting direction intersecting with the axial direction X, herein, the width direction Y and the height direction Z. In this case, the flange part 59 is formed in a substantially long circular shape and in a plate shape, an inner peripheral surface side thereof is integrally connected to a distal end part of the cover part 58, and the flange part 59 is formed to project toward the width direction Y and the height direction Z from an outer face of the cover part 58.

As described above, the second connector 3 includes a plurality of terminals 6 and the connector housing 7, and the terminals 6 are arranged along the axial direction X in the connector housing 7. In the following description, a side in the axial direction X of the second connector 3 with which the first connector 2 is engaged may be referred to as a front side, and the opposite side thereof may be referred to as a rear side.

Specifically, as illustrated in FIGS. 3 and 4, the connector housing 7 includes a plate-shaped base 71, the terminal holding part 72, and a hood part 73. That is, the connector housing 7 includes the plate-shaped base 71, the terminal holding part 72, and the hood part 73 to be integrally formed.

The plate-shaped base 71 is formed in a substantially elliptical plate shape in which the axial direction X is a plate thickness direction. In the second connector 3, the grommet G (refer to FIG. 2, for example) that can cut off water between the plate-shaped base 71 and the attachment panel P is mounted on the plate-shaped base 71.

The terminal holding part 72 is a portion that holds the terminal 6 along the axial direction X (refer to FIG. 6, for example). The terminal holding part 72 is formed in a substantially rectangular parallelepiped shape, and includes a terminal insertion chamber 72*a* formed therein along the axial direction X. The terminal holding part 72 is formed to project toward the front side in the axial direction X from the plate-shaped base 71. The terminal insertion chamber 72*a* passes through the terminal holding part 72 along the axial direction X. The terminal insertion chamber 72*a* is a space part for holding the terminal 6 into which the terminal 6 can be inserted along the axial direction X. The terminal insertion chamber 72*a* may also be referred to as a cavity. The terminal insertion chamber 72*a* extends inside the terminal holding part 72 to be formed in a hollow shape, and houses the terminal 6. The terminal insertion chamber 72*a* extends along the axial direction X. The terminal insertion chamber 72*a* is formed as a space part having a size and a shape into which the terminal 6 can be inserted in accordance with the external shape of the terminal 6. An insertion opening for inserting the terminal 6 is formed on the rear side in the axial direction X of the terminal insertion chamber 72*a*, and an insertion opening into which the terminal 4 of the first connector 2 is inserted is formed on the front side thereof. A plurality of terminal insertion chambers 72*a* are arranged side by side along the width direction Y and the height direction Z in accordance with the number of the terminals 6 arranged in the terminal holding part 72. The terminal holding part 72 includes a lance and the like arranged therein for locking and holding the terminal 6 inside. A plurality of terminal holding parts 72 are arranged. In this case, three terminal holding parts in total, that is, a first terminal holding part 72A, a second terminal holding part 72B, and a third terminal holding part 72C are arranged corresponding to the first sub-connector 55A, the second sub-connector 55B, and the third sub-connector 55C. The first terminal holding part 72A is formed to have an external shape that can be engaged with the engagement space part 50 of the first sub-connector 55A. The second terminal holding part 72B is formed to have an external shape that can be engaged with the engagement space part 50 of the second sub-connector 55B. The third terminal holding part 72C is formed to have an external shape that can be engaged with the engagement space part 50 of the third sub-connector 55C. The first terminal holding part 72A, the second terminal holding part 72B, and the third terminal holding part 72C have a substantially similar basic configuration although a shape, a size, and the like thereof are slightly different from each other. Thus, in the following description, when the first terminal holding part 72A, the second terminal holding part 72B, and the third terminal holding part 72C are not required to be particularly distinguished from each other, they are simply referred to as the terminal holding part 72.

The hood part 73 surrounds the terminal holding part 72 while exposing at least part of each terminal holding part 72 to the outside. The hood part 73 includes a divided hood part 74 and a divided hood part 75. The divided hood part 74 is formed in a substantially semielliptical shape when viewed along the axial direction X (viewed in the axial direction) to collectively surround one side in the height direction Z of the terminal holding parts 72, and the terminal holding parts 72 are positioned inside the divided hood part 74. On the other hand, the divided hood part 75 is formed in a substantially semielliptical shape when viewed along the axial direction X (viewed in the axial direction) to collectively surround the other side in the height direction Z of the terminal holding parts 72, and the terminal holding parts 72 are positioned inside the divided hood part 75. The divided hood part 74 and the divided hood part 75 are formed in a positional relation such that the divided hood part 74 and the divided hood part 75 are opposed to each other across the terminal holding parts 72 in the height direction Z, and both end parts in the width direction Y thereof are opposed to each other with a gap therebetween in the height direction Z. The divided hood parts 74 and 75 are formed to project toward the front side in the axial direction X from the plate-shaped base 71. The divided hood part 74 and the terminal holding parts 72 have substantially the same projecting amount from the plate-shaped base 71 along the axial direction X, and distal end parts thereof on the front side in the axial direction X are substantially aligned to each other. On the other hand, the divided hood part 75 has a projecting amount from the plate-shaped base 71 along the axial direction X smaller than that of the divided hood part 74 and the terminal holding parts 72, and a distal end part thereof on the front side in the axial direction X is positioned closer to the plate-shaped base 71 side than the divided hood part 74 and the terminal holding parts 72. Accordingly, each terminal holding part 72 is configured to be partially exposed to the divided hood part 75 side in the height direction Z.

On the hood part 73, arranged are the locking claw part 9*a* of the locking mechanism 9 for locking a connector, the releasing projection part 10 for releasing a temporal lock, the arm part 11*a* and the lock beak part 11*b* of the locking mechanism 11 for a final lock described above. Two locking claw parts 9*a* of the locking mechanism 9 are formed on an outer face on one side in the height direction Z of the divided hood part 75. The locking claw parts 9*a* are formed at positions opposed to the respective parts 9*b* to be locked arranged at the distal end part of the arm part 9*c* in the axial direction X. The releasing projection parts 10 are arranged, as a pair, on both end parts in the width direction Y of the divided hood part 74. The releasing projection parts 10 are formed at positions opposed to respective arm parts 8*a* of the locking mechanism 8 in the axial direction X. Each releasing projection part 10 has a tapered shape from the rear side toward the front side in the axial direction X. A pair of the arm part 11*a* and the lock beak part 11*b* of the locking mechanism 11 is arranged on an each of outer faces (a face opposite to each terminal holding part 72) on both sides in the width direction Y of the divided hood part 74 (refer to FIG. 9, for example). A base end part of the arm part 11*a* is cantilevered by the outer face of the divided hood part 74, the arm part 11*a* extends in a stick shape along the axial direction X, and a distal end part thereof forms a free end. The base end part of the arm part 11*a* projects along the width direction Y from an end part on the front side in the axial direction X of the divided hood part 74, is bent along the axial direction X, and extends toward the rear side in the axial direction X. The lock beak part 11*b* is arranged at the distal end part of the arm part 11*a*. The arm part 11*a* may also be referred to as a lance part that can be elastically deformed along the width direction Y.

In the first connector 2 according to the present embodiment, the hood part 52 has a notched part 80 as illustrated in FIGS. 3, 4, 5, and 6, for example, as a configuration for causing the connector housing 5 and the connector housing 7 to be engaged with each other along the axial direction X after the connector housing 5 and the connector housing 7 are relatively moved along the height direction Z to be assembled with each other to cause the connector housing 5 and the connector housing 7 configured as described above to be engaged with each other along the axial direction X.

The notched part 80 is a portion formed in the connector housing 5 of the first connector 2 to enable the terminal holding part 72 of the second connector 3 to move along the height direction Z from the outside of the connector housing 5 to an axial direction engagement initial position. The axial direction engagement initial position of the terminal holding part 72 means a position at which the terminal 4 of the first connector 2 and the terminal 6 of the second connector 3 are opposed to each other in the axial direction X, and an engaging operation of the connector housing 5 and the connector housing 7 along the axial direction X can be performed without interference. When the connector housing 5 and the connector housing 7 are relatively moved along the height direction Z to be assembled with each other, the terminal 4 and the terminal 6 are opposed to each other in the axial direction X and an engaging operation along the axial direction X is enabled after the terminal holding part 72 is moved to the axial direction engagement initial position. The notched part 80 is formed at a position for preventing interference between the hood part 52 (the inner hood part 53 and the outer hood part 54) and the terminal holding part 72 when the connector housing 5 and the connector housing 7 are relatively moved along the height direction Z and the terminal holding part 72 is moved to the axial direction engagement initial position.

The engagement space part 50 formed by each inner hood part 53 of each sub-connector 55 described above includes a terminal exposing space part 50A and a movable space part 50B (specifically, refer to FIG. 6, for example). The terminal exposing space part 50A is a space part at which the terminal 4 exposed to the inside of the engagement space part 50 is positioned. On the other hand, the movable space part 50B is a space part adjacent to the terminal exposing space part 50A along the axial direction X. Typically, the terminal exposing space part 50A is a space part positioned on the opposite side of the terminal holding part 51, that is, the front side in the axial direction X with respect to the distal end position of the terminal 4 exposed to the inside of the engagement space part 50 in the axial direction X. Accordingly, the terminal exposing space part 50A can move the terminal holding part 72 of the second connector 3 in the height direction Z to be housed in the terminal exposing space part 50A. Additionally, a part of the engagement space part 50 closer to the terminal holding part 51 is configured as the terminal exposing space part 50A, and a part on the opposite side thereof is configured as the movable space part 50B across the distal end position, as a boundary, of the terminal 4 that is held by the terminal holding part 51 and exposed to the inside of the engagement space part 50 in the axial direction X. The axial direction engagement initial position of the terminal holding part 72 described above is a position at which the terminal holding part 72 is completely housed in the movable space part 50B. The flange part 59 described above is arranged closer to the movable space part 50B side than a boundary position between the terminal exposing space part 50A and the movable space part 50B in the axial direction X, that is, the distal end position of the terminal 4 that is held by the terminal holding part 51 and exposed to the inside of the engagement space part 50. Typically, the flange part 59 functions as a positioning part that abuts on the terminal holding part 72 of the second connector 3 and positions the terminal holding part 72 with respect to the axial direction X.

The notched part 80 is formed on the hood part 52 at a position opposed to the movable space part 50B with respect to the height direction Z. The notched part 80 according to the present embodiment is formed on both of the inner hood part 53 and the outer hood part 54. That is, the notched part 80 includes the notched part 53*b* described above formed on the inner hood part 53 and the notched part 54*a* described above formed on the outer hood part 54. The notched part 53*b* is formed on the inner hood part 53 at an end part on the front side in the axial direction X and on a face (a face opposed to the notched part 54*a* in the height direction Z) opposite to the side on which the arm part 9*c* of the outer hood part 54 is arranged in the height direction Z. The notched part 53*b* is formed to face the movable space part 50B in the height direction Z. The notched part 54*a* is configured of an opening formed toward one side in the height direction Z of the outer hood part 54. The notched part 54*a* is formed on the outer hood part 54 on a side opposite to the side on which the arm part 9*c* is arranged in the height direction Z. The notched part 53*b* and the notched part 54*a* are formed at positions at which the notched part 53*b* and the notched part 54*a* are opposed to each other in the height direction Z, and the notched part 53*b* and the notched part 54*a* are opposed to the movable space part 50B in the height direction Z. The notched part 53*b* and the notched part 54*a* cause the movable space part 50B to communicate with a space part outside the outer hood part 54 of the connector housing 5 along the height direction Z, and enable the terminal holding part 72 to move toward the movable space part 50B along the height direction Z.

The hood part 52 according to the present embodiment includes, at an end part opposite to the terminal holding part 51 in the axial direction X, tapered parts 81 and 82 formed to incline toward the notched part 80 in the axial direction X and the height direction Z (specifically, refer to FIGS. 3, 5, and 6, for example). The tapered part 81 is arranged on each inner hood part 53 of each sub-connector 55. The tapered part 81 is formed on each of wall parts (wall parts along the axial direction X and the height direction Z) of the inner hood parts 53 opposed to each other in the width direction Y. The tapered part 81 is formed to incline toward the notched part 53*b* in the axial direction X and the height direction Z at an end part on the front side in the axial direction X and on the notched part 53*b* side in the height direction Z of the wall parts of the inner hood parts 53. The tapered part 82 is arranged on the outer hood part 54. The tapered part 82 is formed on the wall parts (wall parts along the axial direction X and the height direction Z) of the outer hood part 54 opposed to each other in the width direction Y. The tapered part 82 is formed to incline toward the notched part 54*a* in the axial direction X and the height direction Z at an end part on the front side in the axial direction X and on the notched part 54*a* side in the height direction Z of the wall parts of the outer hood part 54.

In the connector mechanism 1 configured as described above, when the connector housing 5 of the first connector 2 is inserted and pressed into the attachment hole Pa formed on the attachment panel P along the axial direction X, the lock beak part 8*b* is locked to the attachment edge on the periphery of the attachment hole Pa of the attachment panel P. In this case, in the first connector 2, when the lock beak part 8*b* of the locking mechanism 8 is pressed into the attachment edge of the attachment panel P while abutting thereon, each arm part 8*a* is distorted and deformed toward the inside in the width direction Y (connector housing 5 side) from an initial position. When the locking mechanism 8 is further pressed, the lock beak part 8*b* gets over the attachment edge of the attachment panel P from one side to the other side in the axial direction X. In the locking mechanism 8, each arm part 8*a* is elastically returned to the initial position, and the lock beak part 8*b* is locked to the attachment edge of the attachment panel P. That is, in the first connector 2, when the lock beak part 8*b* is locked to the attachment edge of the attachment panel P and movement of the connector housing 5 toward one side along the axial direction X is restricted in a state in which the connector housing 5 of the first connector 2 is inserted into the attachment hole Pa formed on the attachment panel P, the connector housing 5 is temporarily locked to the attachment edge of the attachment panel P (refer to FIG. 1).

In the connector mechanism 1, the connector housing 7 of the second connector 3 is engaged with the connector housing 5 of the first connector 2 that is inserted into the attachment hole Pa and waiting at the attachment hole Pa. In this case, as illustrated in FIG. 6 for example, before the connector housing 5 of the first connector 2 and the connector housing 7 of the second connector 3 are engaged with each other along the axial direction X, the connector mechanism 1 can cause the first connector 2 and the second connector 3 to be relatively moved along the height direction Z intersecting with the axial direction X to be assembled with each other. In this case, the connector mechanism 1 causes the terminal holding part 72 exposed in the height direction Z from the divided hood part 75 side in the second connector 3 to be moved in a sliding manner toward the movable space part 50B in the inner hood part 53 along the height direction Z via the notched part 54*a* of the outer hood part 54 of the first connector 2 and the notched part 53*b* of the inner hood part 53 from the divided hood part 75 side. At this point, by causing a distal end part on the front side in the axial direction X of the terminal holding part 72 of the second connector 3 to abut on the flange part 59 of the first connector 2, the connector mechanism 1 can position, in the axial direction X, the terminal holding part 72 at a position at which the terminal holding part 72 can be moved in a sliding manner in the height direction Z. In this case, in the first connector 2, the notched part 53*b* and the notched part 54*a* formed on the inner hood part 53 and the outer hood part 54 function as openings for causing the terminal holding part 72 to be moved toward the movable space part 50B along the height direction Z. That is, in the first connector 2, when the connector housing 5 and the connector housing 7 are relatively moved along the height direction Z, and the terminal holding part 72 is moved to the axial direction engagement initial position in the inner hood part 53, the hood part 52 including the inner hood part 53 and the outer hood part 54 can be prevented from interfering with the terminal holding part 72 due to the notched part 80 including the notched part 53*b* and the notched part 54*a*. Accordingly, as illustrated in FIG. 7, the first connector 2 can cause the terminal holding part 72 to move from the outside of the connector housing 5 to the movable space part 50B side in the inner hood part 53 along the height direction Z due to action of the notched part 80, and can cause the terminal holding part 72 to move to the axial direction engagement initial position.

Figure 9:
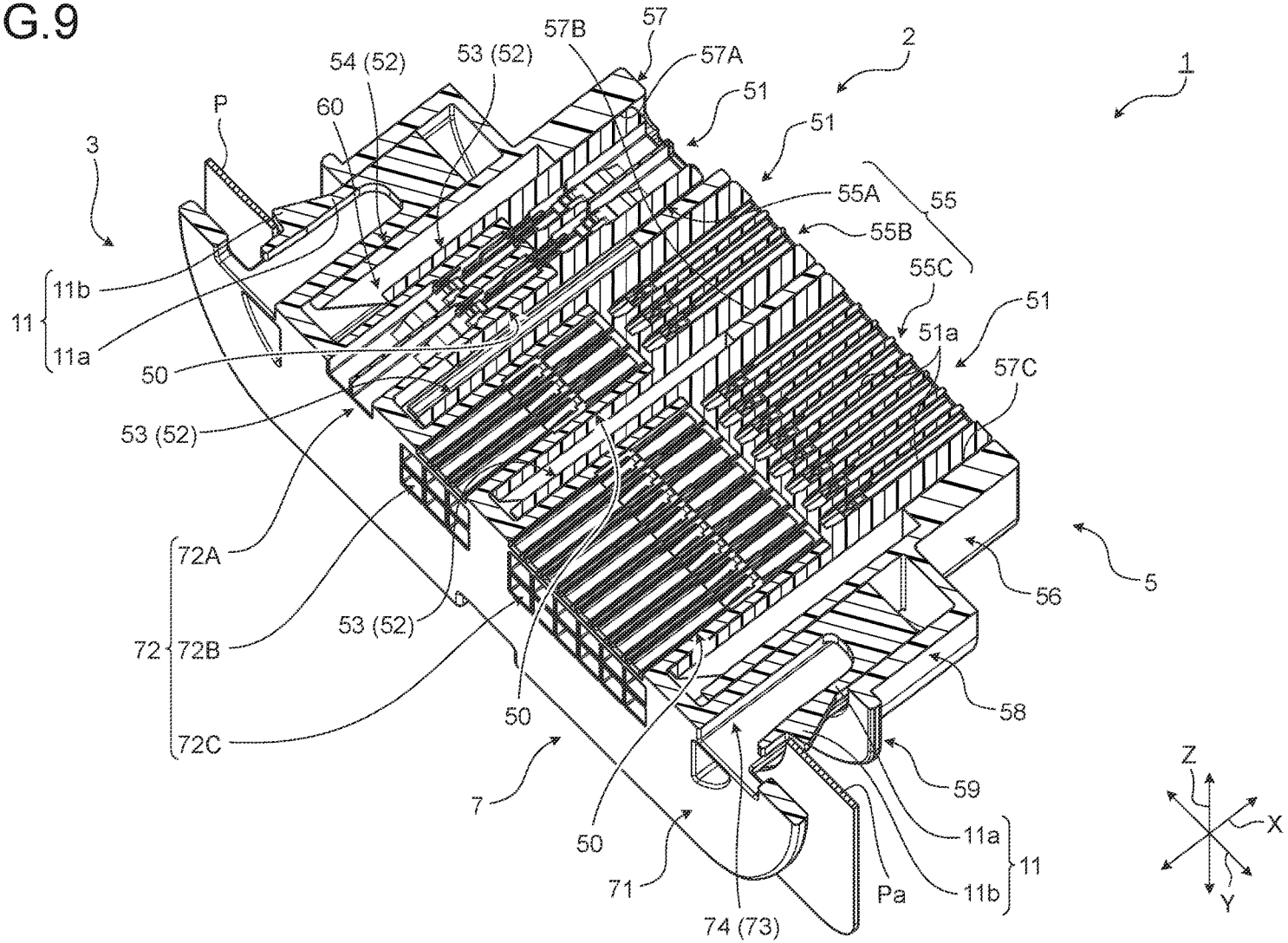
FIG. 9 is a cross-sectional perspective view for explaining an engaging operation of the connector mechanism according to the embodiment.

In the connector mechanism 1, in a case in which the connector housing 5 and the connector housing 7 are relatively moved along the height direction Z to be assembled with each other, when the terminal holding part 72 is completely housed in the movable space part 50B and moved to the axial direction engagement initial position, the connector housing 5 and the connector housing 7 are enabled to be engaged with each other along the axial direction X. That is, in the connector mechanism 1, obtained is a state in which the connector housing 5 and the connector housing 7 can be properly engaged with each other along the axial direction X without interference when the connector housing 5 and the connector housing 7 are engaged with each other along the axial direction X. In the connector mechanism 1, when the connector housing 7 of the second connector 3 is pressed into the connector housing 5 of the first connector 2 along the axial direction X in a state in which the terminal holding part 72 is at the axial direction engagement initial position in the movable space part 50B, as illustrated in FIGS. 8 and 9, the terminal holding part 72 advances into the terminal exposing space part 50A of the engagement space part 50 to be completely engaged therewith, and the terminal 4 and the terminal 6 are electrically connected to each other. At this point, in the connector mechanism 1, when the locking claw part 9*a* on the second connector 3 side distorts and pushes up the arm part 9*c* on the first connector 2 side and the connector housing 5 and the connector housing 7 are completely engaged with each other in accordance with an engaging operation of pressing the connector housing 7 into the connector housing 5 along the axial direction X, the arm part 9*c* is returned to the initial position side, the locking claw part 9*a* is locked to the part 9*b* to be locked, and the connector housing 5 and the connector housing 7 are locked to each other. In the connector mechanism 1, a temporal lock between the connector housing 5 and the attachment panel P via the lock beak part 8*b* is released to be free when the arm part 8*a* is distorted by the releasing projection part 10 in accordance with the engaging operation of pressing the connector housing 7 into the connector housing 5 along the axial direction X. On the other hand, similarly to the case of the locking mechanism 8, when the lock beak part 11*b* of the locking mechanism 11 gets over the attachment edge of the attachment panel P from the other side toward one side in the axial direction X to be locked to the attachment edge of the attachment panel P, the connector housing 7 is finally locked to the attachment edge of the attachment panel P (refer to FIGS. 2, 8, and 9, for example). In this state, in the connector mechanism 1, the first terminal holding part 72A, the second terminal holding part 72B, and the third terminal holding part 72C are engaged with the engagement space parts 50 of the inner hood parts 53 of the first sub-connector 55A, the second sub-connector 55B, and the third sub-connector 55C, respectively, the outer hood part 54 is engaged with the inside of the hood part 73 of the second connector 3, and the terminal 4 and the terminal 6 are electrically connected to each other. Thereafter, in the connector mechanism 1, the grommet G is mounted on the plate-shaped base 71 configuring the second connector 3.

The first connector 2 and the wire harness WH described above can cause the terminal holding part 72 of the second connector 3 to move from the outside of the connector housing 5 to the axial direction engagement initial position in the connector housing 5 along the height direction Z via the notched part 80. Thus, after the first connector 2 and the second connector 3 are relatively moved along the height direction Z intersecting with the axial direction X to be assembled with each other, the first connector 2 and the wire harness WH can cause the connector housing 5 of the first connector 2 and the connector housing 7 of the second connector 3 to be engaged with each other along the axial direction X, and can cause the terminal 4 and the terminal 6 to be electrically connected to each other. As a result, for example, in a case in which a working space cannot be secured along the axial direction X for the engaging operation of the first connector 2 and the second connector 3, the first connector 2 and the wire harness WH can cause the first connector 2 and the second connector 3 to be engaged with each other with a relatively short stroke along the axial direction X after causing the first connector 2 and the second connector 3 to be relatively moved along the height direction Z to be assembled with each other. Accordingly, the engaging operation can be easily performed in a space-saving manner, so that workability can be improved.

In the first connector 2 and the wire harness WH described above, the notched part 80 is arranged at a position opposed in the height direction Z to the movable space part 50B adjacent to the terminal exposing space part 50A in the engagement space part 50 within the hood part 52 of the connector housing 5. Accordingly, the first connector 2 and the wire harness WH can cause the terminal holding part 72 to move from the outside of the connector housing 5 toward the movable space part 50B within the inner hood part 53 along the height direction Z, and to the axial direction engagement initial position, while preventing the terminal holding part 72 from interfering with the terminal 4 in the terminal exposing space part 50A. Accordingly, the first connector 2 and the wire harness WH can cause the first connector 2 and the second connector 3 to be properly engaged with each other.

In the first connector 2 and the wire harness WH described above, the notched part 53*b* and the notched part 54*a* are formed on the inner hood part 53 and the outer hood part 54 configuring the hood part 52, respectively. Thus, even when the sub-connector 55 including the inner hood part 53 and the outer hood part 54 are configured to be detachable from each other, the first connector 2 and the second connector 3 can be engaged with each other along the axial direction X after being properly relatively moved along the height direction Z to be assembled with each other, which improves workability. The sub-connector 55 may include, for example, various connectors such as a connector for an air bag. In the connector mechanism 1, when the first connector 2 and the second connector 3 are engaged with each other, the sub-connectors 55 configuring the various connectors are collectively engaged with each other, so that workability can be improved also in this viewpoint. In this case, on the attachment panel P, the attachment hole Pa is not necessarily individually arranged for each of the various connectors such as a connector for an air bag, and one attachment hole Pa may be sufficient for the various connectors. Accordingly, strength of the attachment panel P can be relatively improved as compared with a case in which a large number of attachment holes Pa are arranged.

In the first connector 2 and the wire harness WH described above, by causing the distal end part on the front side in the axial direction X of the terminal holding part 72 of the second connector 3 to abut on the flange part 59 of the first connector 2, the terminal holding part 72 can be easily positioned at a position at which the terminal holding part 72 can be moved along the height direction Z in a sliding manner, so that workability can be improved also in this viewpoint.

The connector mechanism 1 according to the present embodiment is not limited to a configuration in which the first connector 2 and the second connector 3 are engaged with each other along the axial direction X after being relatively moved along the height direction Z to be assembled with each other as described above. For example, when a working space for an engaging operation can be secured along the axial direction X, the first connector 2 and the second connector 3 can be directly engaged with each other along the axial direction X. At this point, in the first connector 2, the tapered parts 81 and 82 are formed toward the notched part 53*b* and the notched part 54*a* at the distal end parts of the inner hood part 53 and the outer hood part 54 configuring the hood part 52 described above, so that the tapered parts 81 and 82 function as a rake face for the distal end part on the front side in the axial direction X of the terminal holding part 72. Accordingly, in the first connector 2 and the wire harness WH, for example, the tapered parts 81 and 82 function as the rake face for the distal end part of the terminal holding part 72 when the first connector 2 and the second connector 3 are engaged with each other along the axial direction X or when the first connector 2 and the second connector 3 are engaged with each other from an oblique direction inclining with respect to the axial direction X and the height direction Z to reduce what is called a collision and the like from being caused, and positioning with respect to the width direction Y can be facilitated for example, so that workability can be improved also in this viewpoint.

Figure 10:
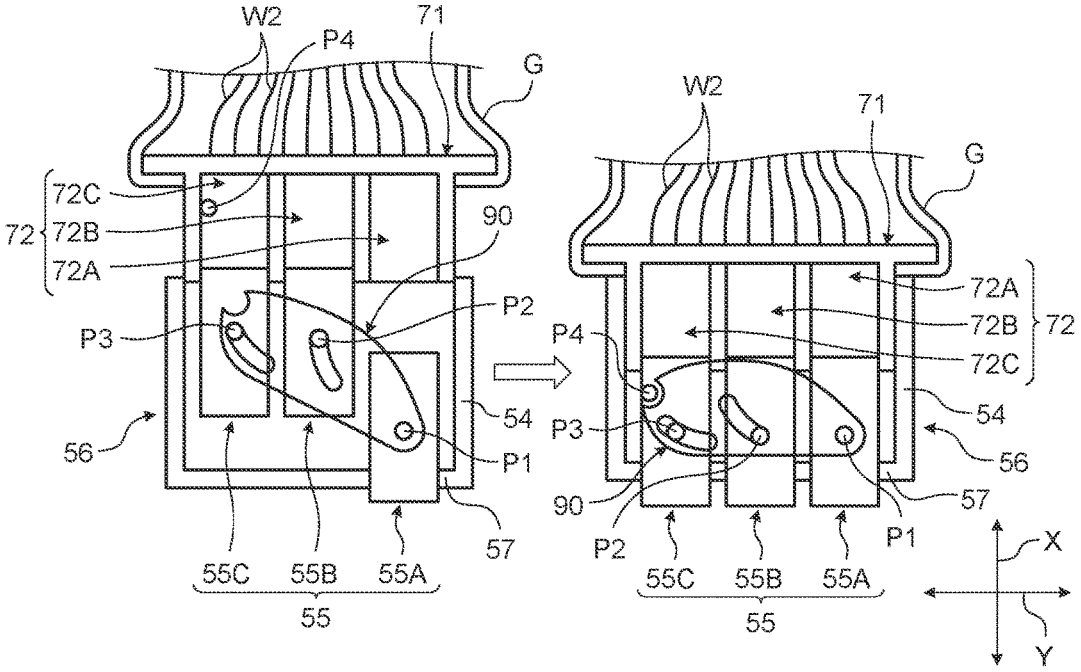
FIG. 10 is a typical configuration diagram for explaining a lever mechanism that can be applied to the connector mechanism according to the embodiment.
Figure 11:
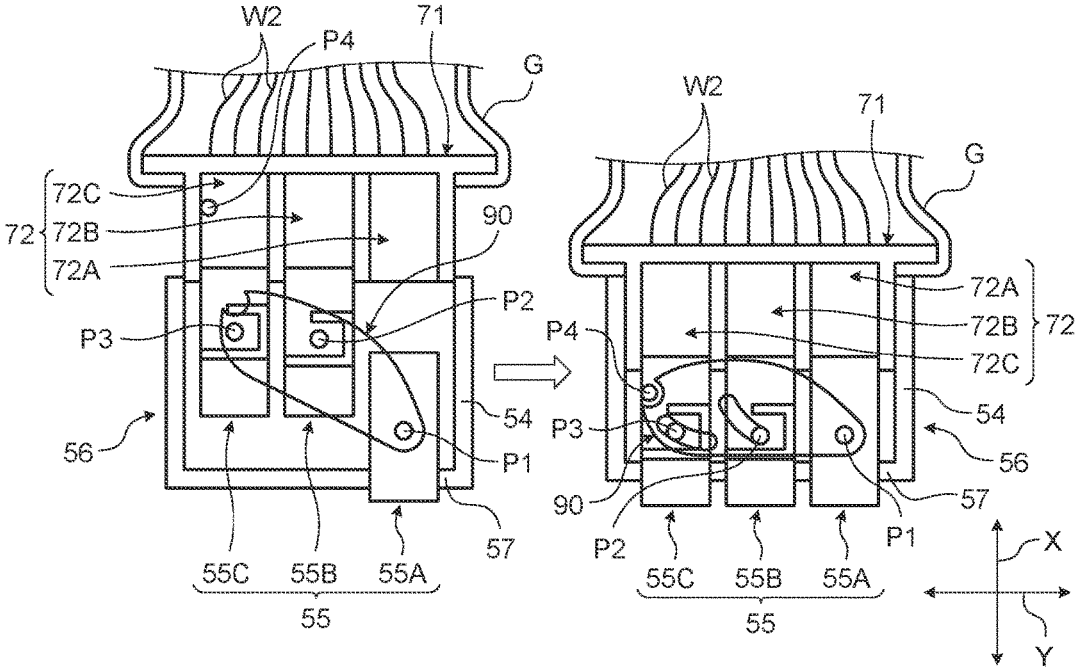
FIG. 11 is a typical configuration diagram for explaining the lever mechanism that can be applied to the connector mechanism according to the embodiment.

In the connector mechanism 1, for example, as illustrated in FIGS. 10 and 11, the first sub-connector 55A is fixed to the sub-connector holding part 57 of the main body part 56, the second sub-connector 55B and the third sub-connector 55C are held to be able to be individually relatively moved along the axial direction X with respect to the sub-connector holding part 57, and the first sub-connector 55A, the second sub-connector 55B, and the third sub-connector 55C are coupled to each other by a lever mechanism (LIF mechanism) 90, so that a principle of leverage can be used to engage the first connector 2 with the second connector 3. In this case, in the lever mechanism 90, for example, a rotation fulcrum P1 is arranged in the first sub-connector 55A, points of application P2 and P3 are arranged in the second sub-connector 55B and the third sub-connector 55C, respectively, and a point of effort P4 is arranged in the third terminal holding part 72C. In an initial state of the first sub-connector 55A, the second sub-connector 55B, and the third sub-connector 55C, the second sub-connector 55B and the third sub-connector 55C are positioned and arranged on the front side in the axial direction X with respect to the first sub-connector 55A, and are locked to the sub-connector holding part 57 with a locking mechanism. In this case, the locking mechanism has a configuration in which the lock of the second sub-connector 55B and the third sub-connector 55C are released at the timing when the second sub-connector 55B and the third sub-connector 55C are completely engaged with the second terminal holding part 72B and the third terminal holding part 72C, and the second sub-connector 55B and the third sub-connector 55C are enabled to be moved to the rear side in the axial direction X. The lever mechanism 90 utilizes the principle of leverage in accordance with the engaging operation of causing the connector housing 5 of the first connector 2 and the connector housing 7 of the second connector 3 to be engaged with each other along the axial direction X, causes the third sub-connector 55C to be engaged with the third terminal holding part 72C, causes the second sub-connector 55B to be engaged with the second terminal holding part 72B, and causes the first sub-connector 55A to be engaged with the first terminal holding part 72A in this order in stages to shift the timing of engagement of each sub-connector 55 (timing at which a required engagement force becomes maximum). Accordingly, the connector mechanism 1 suppresses a maximum value of the engagement force required for causing the connector housing 5 of the first connector 2 and the connector housing 7 of the second connector 3 to be engaged with each other along the axial direction X, so that workability can be improved also in this viewpoint. The lever mechanism 90 exemplified in FIG. 10 and the lever mechanism 90 exemplified in FIG. 11 operate in substantially the same manner although a configuration of a connecting portion between the lever mechanism 90 and each of the second sub-connector 55B and the third sub-connector 55C is slightly different.

The connector and the wire harness according to the embodiment of the present invention described above are not limited to the above embodiment, and can be variously modified without departing from the scope of the present invention.

In the above description, in the connector housing 5, the hood part 52 includes the inner hood part 53 and the outer hood part 54, and the sub-connector 55 including the terminal holding part 51 and the inner hood part 53 and the main body part 56 including the outer hood part 54 are formed separately from each other and to be detachable from each other. However, the embodiment is not limited thereto. In the connector housing 5, the hood part 52 may be configured only with the outer hood part 54 without the inner hood part 53, and the hood part 52 and the terminal holding part 51 may be integrally formed. In the connector housing 5, when the cover part 58 extends to the distal end position of the hood part 52 in the axial direction X, the cover part 58 also configures part of the hood part, and the notched part described above is arranged thereon. Similarly to the first connector 2, in the second connector 3, the terminal holding part 72 may be formed separately from the hood part 73, and a sub-connector detachable from a portion including the hood part 73 may be configured. In the above description, the flange part 59 is arranged closer to the movable space part 50B than the boundary position between the terminal exposing space part 50A and the movable space part 50B in the axial direction X, that is, the distal end position of the terminal 4 that is held by the terminal holding part 51 and exposed to the inside of the engagement space part 50, but the embodiment is not limited thereto. The flange part 59 may be arranged at another position, or is not necessarily arranged. In the above description, the hood part 52 includes the tapered parts 81 and 82, but the embodiment is not limited thereto.

In the above description, the first connector 2 is the receiving side connector, and the second connector 3 is the assembling side connector. However, the embodiment is not limited thereto. The first connector 2 may be the assembling side connector, and the second connector 3 may be the receiving side connector. The connector does not have to be the panel-fixed type connector in the first place.

Figure 12:
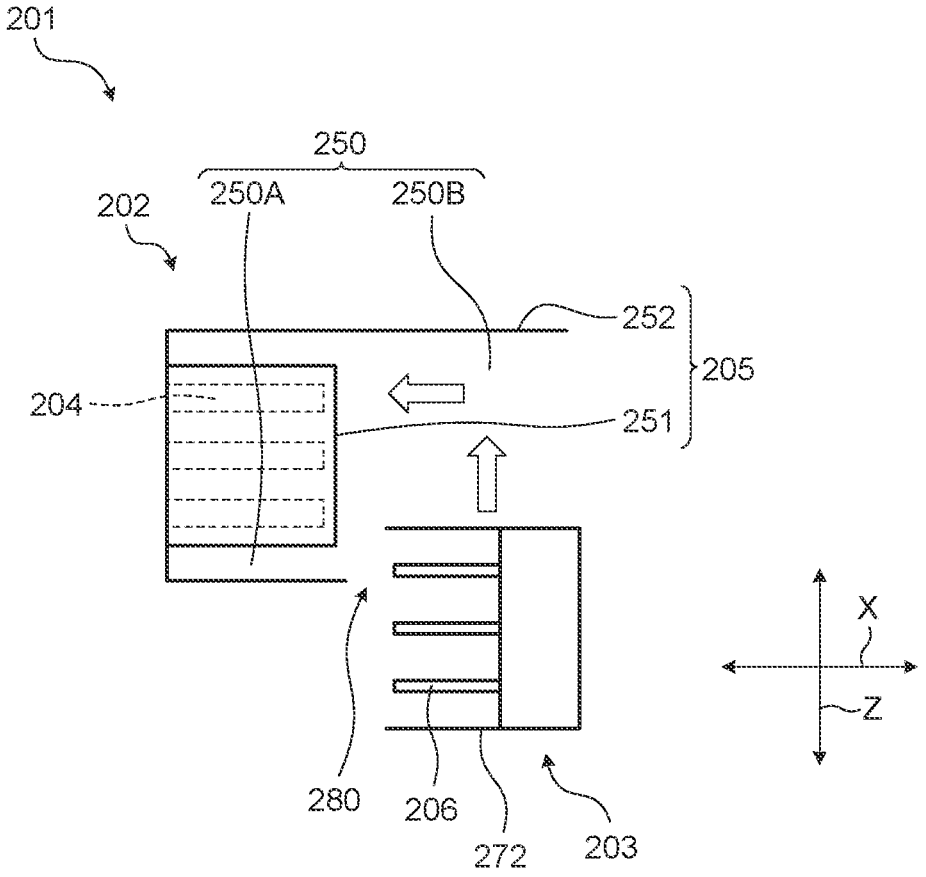
FIG. 12 is a typical configuration diagram representing a schematic configuration of the connector mechanism according to another embodiment.

In the first connector 2, the connector housing 5 may be a female connector that holds a female terminal, and in this case, in the second connector 3 as a counterpart connector, the connector housing 7 may be a male connector that holds a male counterpart terminal. That is, a male/female relation therebetween may be reversed. For example, a connector mechanism 201 according to another embodiment illustrated in FIG. 12 includes a first connector 202 serving as a female connector and a second connector 203 serving as a male connector and a counterpart connector. The first connector 202 includes a female terminal 204 that can be connected to a male terminal 206 serving as a counterpart terminal arranged in the second connector 203, and a connector housing 205 that includes the terminal 204 arranged therein along the axial direction X and can be engaged with the second connector 203 along the axial direction X. The connector housing 205 includes a notched part 280 that enables a terminal holding part 272 serving as a counterpart terminal holding part that holds the terminal 206 in the second connector 203 and is exposed to the outside to move to an axial direction engagement initial position at which the terminal 204 and the terminal 206 are opposed to each other in the axial direction X from the outside of the connector housing 205 along the height direction Z as an intersecting direction intersecting with the axial direction X. More specifically, the connector housing 205 includes a terminal holding part 251 that holds the terminal 204 along the axial direction X, and a hood part 252 that covers the terminal holding part 251 and forms an engagement space part 250 with which the terminal holding part 272 can be engaged. The engagement space part 250 includes a terminal holding part space part 250A in which the terminal holding part 251 is positioned, and a movable space part 250B adjacent to the terminal holding part space part 250A along the axial direction X. The notched part 280 is formed in the hood part 252 at a position opposed to the movable space part 250B in the height direction Z. Also in this case, the first connector 202 can cause the terminal holding part 272 of the second connector 203 to be moved to the axial direction engagement initial position in the connector housing 205 from the outside of the connector housing 205 along the height direction Z via the notched part 280, so that workability can be improved.

In the connector and the wire harness according to the embodiment, the counterpart terminal holding part of the counterpart connector can be moved to the axial direction engagement initial position from the outside of the connector housing along the intersecting direction intersecting with the axial direction via the notched part, so that the connector and the counterpart connector can be engaged with each other along the axial direction after being relatively moved along the intersecting direction to be assembled with each other, and the terminal and the counterpart terminal can be electrically connected to each other. As a result, the connector and the wire harness can perform the engaging operation in a space-saving manner, so that the workability can be improved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a connector housing including:

a terminal arranged along an axial direction of the connector housing and configured to be connected to a counterpart terminal arranged in a counterpart connector; and a hood part that forms an engagement space part to which a distal end of the terminal held by a terminal holding part is exposed and with which a counterpart terminal holding part is able to be engaged, the hood part including a notched part that enables the counterpart terminal holding part, which holds the counterpart terminal and is exposed to an exterior of the counterpart connector, to move to an axial direction engagement initial position where the terminal and the counterpart terminal are opposed to each other in the axial direction in an unassembled state, wherein the connector housing is configured to engage with the counterpart connector along the axial direction, wherein the connector housing includes the terminal holding part that holds the terminal along the axial direction, wherein the engagement space part includes:

a terminal exposing space part at which the terminal exposed to inside of the engagement space part is positioned, and a movable space part adjacent to the terminal exposing space part along the axial direction, wherein the notched part formed at a position opposed to the movable space part in the intersecting direction, wherein the connector housing has a flange part formed projecting along the intersecting direction from an outer face closer to the movable space part with respect to a boundary position between the terminal exposing space part and the movable space part in the axial direction, and wherein the flange part abuts on the counterpart terminal holding part to be positioned in the axial direction.

2. The connector according to claim 1, wherein the hood part includes an inner hood part that configures a sub-connector integrally with the terminal holding part, and an outer hood part that is formed separately from the sub-connector outside the inner hood part in the intersecting direction to be detachable from the sub-connector, and the notched part is formed on the outer hood part and the inner hood part.

3. The connector according to claim 1, wherein the hood part has a tapered part formed to incline toward the notched part with respect to the axial direction and the intersecting direction at an end part opposite to the terminal holding part in the axial direction.

4. The connector according to claim 2, wherein the hood part has a tapered part formed to incline toward the notched part with respect to the axial direction and the intersecting direction at an end part opposite to the terminal holding part in the axial direction.

5. A wire harness comprising:

a conductive wiring material; and a connector that is connected to the wiring material, wherein the connector includes:

a connector housing including:

a terminal connected to the wiring material and configured to be connected to a counterpart terminal arranged in a counterpart connector, the terminal arranged in the connector housing along an axial direction thereof and the terminal is configured to connect with the counterpart connector along the axial direction, and a hood part that forms an engagement space part to which a distal end of the terminal held by a terminal holding part is exposed and with which a counterpart terminal holding part is able to be engaged, the hood part including a notched part that enables the counterpart terminal holding part, which holds the counterpart terminal and is exposed to an exterior of the counterpart connector, to move to an axial direction engagement initial position at where the terminal and the counterpart terminal are opposed to each other in the axial direction in an unassembled state, wherein the connector housing is configured to engage with the counterpart connector along the axial direction, wherein the connector housing includes a the terminal holding part that holds the terminal along the axial direction, wherein the engagement space art includes:

a terminal exposing space part a which the terminal exposed to inside of the engagement space part is positioned, and a movable space part adjacent to the terminal exposing space part along the axial direction, wherein the notched part formed at a position opposed to the movable space part in the intersecting direction, wherein the connector housing has a flange part formed projecting along the intersecting direction from an outer face closer to the movable space part with respect to a boundary position between the terminal exposing space part and the movable space part in the axial direction, and wherein the flange part abuts on the counterpart terminal holding part to be positioned in the axial direction.

* * * * *